US009596932B2

(12) United States Patent
Greussing

(10) Patent No.: US 9,596,932 B2
(45) Date of Patent: Mar. 21, 2017

(54) PULL-OUT GUIDE FOR A DRAWER

(71) Applicant: Julius Blum GmbH, Hoechst (AT)

(72) Inventor: Ulrich Greussing, Bizau (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 14/269,446

(22) Filed: May 5, 2014

(65) Prior Publication Data

US 2014/0241651 A1 Aug. 28, 2014

Related U.S. Application Data

(63) Continuation of application No. PCT/AT2012/000245, filed on Sep. 28, 2012.

(30) Foreign Application Priority Data

Nov. 16, 2011 (AT) ..... 1695/2011

(51) Int. Cl.
*A47B 88/04* (2006.01)
*A47B 88/10* (2006.01)
*A47B 88/14* (2006.01)

(52) U.S. Cl.
CPC ..... *A47B 88/10* (2013.01); *A47B 88/14* (2013.01)

(58) Field of Classification Search
CPC ..... A47B 88/10; A47B 88/14; A47B 88/0466; A47B 2210/004; A47B 2210/0035
USPC ..... 312/330.1, 334.6, 334.8, 334.12, 334.9, 312/334.15, 334.18, 334.27, 334.33, 312/334.39
See application file for complete search history.

(56) References Cited

U.S. PATENT DOCUMENTS

| | | | | |
|---|---|---|---|---|
| 5,344,227 | A | 9/1994 | Rock et al. | |
| 6,682,160 | B2 * | 1/2004 | Kung | 312/334.6 |
| 7,156,478 | B2 * | 1/2007 | Harn et al. | 312/334.6 |
| 7,465,001 | B2 * | 12/2008 | Lam et al. | 312/334.15 |
| 8,678,529 | B2 * | 3/2014 | Li | 312/334.6 |
| 2005/0231083 | A1 | 10/2005 | Garcie, Jr. | |
| 2007/0080616 | A1 * | 4/2007 | Lam et al. | 312/334.6 |
| 2007/0080617 | A1 | 4/2007 | Lam et al. | |

(Continued)

FOREIGN PATENT DOCUMENTS

| | | |
|---|---|---|
| CN | 2539433 | 3/2003 |
| CN | 101683218 | 3/2010 |

(Continued)

OTHER PUBLICATIONS

International Search Report (ISR) issued Dec. 10, 2012 in International (PCT) Application No. PCT/AT2012/000245.

(Continued)

*Primary Examiner* — James O Hansen
(74) *Attorney, Agent, or Firm* — Wenderoth, Lind & Ponack, L.L.P.

(57) ABSTRACT

A pull-out guide for a drawer includes a body rail that is to be attached to a furniture body, a drawer rail that is to be attached to the drawer, and a central rail that is movably mounted between the body rail and the drawer rail. At least one carriage having at least one rolling element is mounted in a movable manner between the central rail and the drawer rail. The at least one rolling element runs on at least one support profile of the central rail, and the at least one support profile is arranged as a separate component on the central rail.

19 Claims, 4 Drawing Sheets

(56) References Cited

U.S. PATENT DOCUMENTS

2009/0238503 A1 9/2009 Liang et al.

FOREIGN PATENT DOCUMENTS

| | | |
|---|---|---|
| DE | 32 46 915 | 6/1984 |
| DE | 20 2004 006 284 | 5/2005 |
| DE | 20 2009 003 883 | 7/2009 |
| JP | 5-505967 | 9/1993 |
| WO | 2005/044047 | 5/2005 |
| WO | 2010/037260 | 4/2010 |

OTHER PUBLICATIONS

Austrian Patent Office Search Report (ASR) issued Jun. 20, 2012 in Austrian Patent Application No. A 1695/2011.
Chinese Office Action (OA) and Search Report (SR) issued Apr. 3, 2015 in counterpart Chinese Application No. 201280056050.0.

* cited by examiner

PULL-OUT GUIDE FOR A DRAWER

BACKGROUND OF THE INVENTION

The invention concerns an extension guide for a drawer including a carcass rail to be fixed to a furniture carcass, a drawer rail to be fixed to the drawer, and a central rail mounted movably between the carcass rail and the drawer rail. At least one running carriage having at least one rolling body is mounted displaceably between the central rail and the drawer rail, and the at least one rolling body runs on at least one support profile of the central rail.

Such extension guides belong to the state of the art and are described for example in German Utility Model specification DE 20 2009 003 883 U1. In that case, the central rail is shaped so that, viewed in cross-section, it has at both sides two support profiles on which the ball bearings of two running carriages run. In that case, the purpose of the support profiles is to prevent the running carriages from lifting off the central rail and/or to reduce the tilting play which generally occurs in the case of extension guides without a support profile and which occurs due to the relative clearance between the rails and the at least one running carriage.

That central rail therefore differs from the shape which is usually found to involve of a U-profile having two vertical legs and a horizontal bar which connects the two vertical legs, in which the deviation involves in particular the bend edges between the two vertical legs and the horizontal bar.

A disadvantage in that respect is that production of the central rail and thus the entire extension guide is highly complicated and cost-intensive in comparison with the standard form, by virtue of that specific configuration which requires a special bending process.

SUMMARY OF THE INVENTION

The object of the present invention is to avoid the above-described disadvantages and to provide an extension guide which is less expensive and simplified in comparison with the state of the art.

To attain that object, the invention proposes that the at least one support profile is arranged as a separate structural unit on the central rail.

The invention is based in particular on the realization that it is only necessary at all under certain circumstances for the central rail to have a support profile to prevent the running carriage from lifting off. More specifically, the weight of the drawer is normally relatively uniformly distributed to the extension guides, so that the risk of lifting off does not arise at all. In those cases, the at least one support profile can be readily omitted and thus material can be saved. If, however, the extension guide is to be used for drawers which for example have a front panel which is very heavy in comparison with the other drawer components and are thus greatly nose-heavy, then the at least one support profile is necessary in particular to avoid the front of the drawer from tipping out in the pushed-in condition of the drawer.

Because the at least one support profile according to the invention is a separate structural unit, it is possible for the central rail to be retro-fitted modularly specifically for rather rare special cases, in which respect such retro-fitting can either already be effected at the factory in manufacture of the extension guide, or it can be effected by the user.

It should also be noted that the at least one rolling body which runs on the at least one support profile can be a runner, a roller or a ball.

To prevent the front of the drawer from tipping out as referred to above in the pushed-in condition of the drawer, preferably two measures can be implemented. The first measure provides that the at least one running carriage engages under the at least one support profile in the position of use of the extension guide with the at least one rolling body to safeguard against being lifted off the central rail. The second measure provides that at least one contact leg is arranged on the drawer rail, and the drawer rail engages under at least one rolling body arranged on the at least one running carriage in the position of use of the extension guide with the at least one contact leg to safeguard against lifting off of the at least one running carriage. If both measures are implemented, then the drawer which is fixed to the drawer rail is prevented by the extension guide from lifting off—to put it in brief terms—by double engagement under the support profile.

In an advantageous embodiment of the invention, the at least one support profile extends at least portion-wise in the longitudinal direction of the central rail. To prevent the front of the drawer from tilting out in the pushed-in condition of the drawer or to reduce the tilting play described in the introductory part of this description, it may also be sufficient if the at least one support profile extends in the longitudinal direction only over a partial region of the central rail—expressed in numbers, over a partial region of between 20% and 60%, and preferably over a partial region of between 30% and 40% of the central rail. If precisely two running carriages are mounted displaceably between the central rail and the drawer rail, the at least one support profile can extend in the longitudinal direction only over a rear partial region of the central rail, that is arranged in the proximity of the drawer rear wall, or that partial region of the central rail, in which the second rear running carriage is displaceably mounted.

BRIEF DESCRIPTION OF THE DRAWINGS

Further details and advantageous embodiments of the invention are described more fully in the specific description hereinafter with reference to the Figures, in which.

DETAILED DESCRIPTION OF THE INVENTION

Figure 1B:
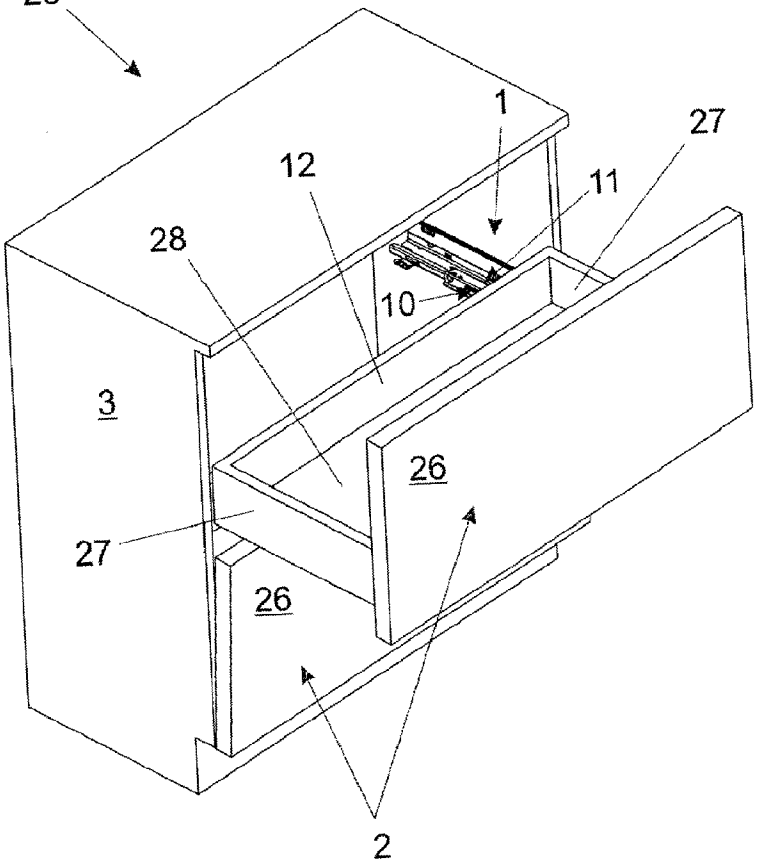
FIG. 1*b* is a diagrammatically illustrated perspective view of the drawer box of FIG. 1*a*, the upper drawer being in the pulled-out condition and the lower drawer in the pushed-in condition.
Figure 1A:
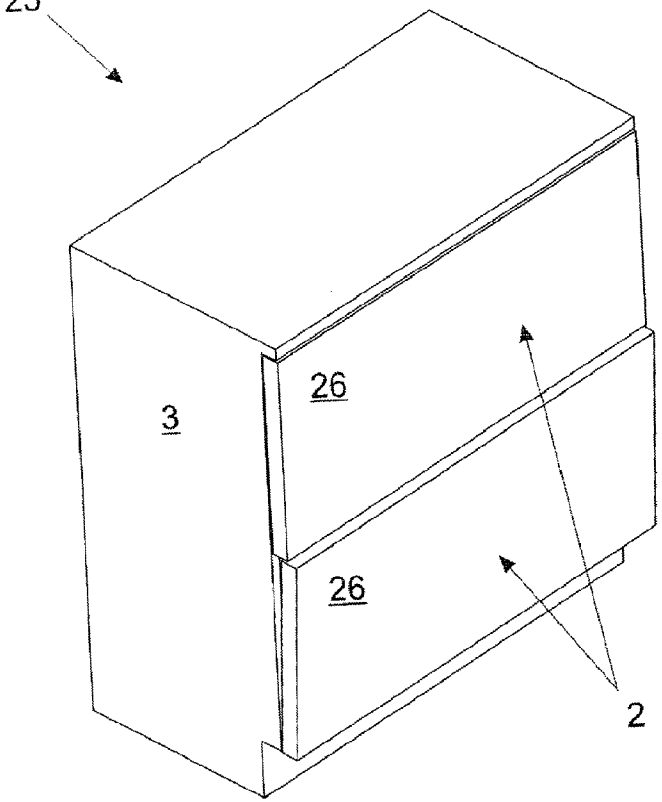
FIG. 1*a* is a diagrammatically illustrated perspective view of a drawer box with two drawers in the pushed-in condition.

FIGS. 1*a* and 1*b* show diagrammatically illustrated perspective views of a drawer article of furniture 25 with two drawers 2 arranged one above the other. The two drawers 2 are respectively fixed to the furniture carcass 3 of the drawer article of furniture 25 by two extension guides 1 arranged at right and left sides, and can be pushed into and pulled out of the article of furniture 25 by those extension guides 1. The two drawers 2 are severely nose-heavy drawers as on the one hand they are of a small depth while on the other hand their front panel 26 is relatively heavy compared to the other drawer components including the drawer rear wall 12, the two drawer side walls 27, and the drawer bottom 28. The two extension guides for the upper drawer, in contrast to the extension guides of the lower drawer, have the support profiles 10 and 11 according to the invention whereby the drawer front 26 in the case of the upper drawer in comparison with the lower drawer is prevented from tipping out in the pushed-in condition of the drawer.

The details of the two extension guides 1 of the upper drawer will be described more fully hereinafter by reference to FIGS. 2*a*, 2*b*, 3 and 4. In specific terms, a so-called full extension can be implemented with these extension guides 1 (that is to say, the drawer rear wall is in the front plane of the article of furniture when the drawer is in the pulled-out condition). That is achieved by the extension guide 1 comprising three rails, a carcass rail 4 which can be fixed to the furniture carcass by way of holes 49 for receiving screws, a drawer rail 5 to be fixed to the drawer, and a central rail 6 supported movably between the carcass rail 4 and the drawer rail 5. In the preferred embodiment of the extension guide 1 illustrated, the drawer rail 5 has three per se known particularities.

Firstly, mounted laterally to the drawer rail 5 is a damped, spring-assisted retraction device 29 including a force storage member in the form of a spring. That spring is prestressed when the extension guide 1 is pulled out by a pin 31 which is fixed to the carcass rail 4 and which is at the end face of an angle portion 30. As from a given position when pushing on the extension guide 1, that pin 31 engages again into a slider which is fixed to the spring and the energy stored in the spring is liberated and causes the extension guide 1 to be completely pulled in over the remaining distance that is still to be covered. So that this movement takes place in a damped fashion, the retraction device 29 includes a damping device which counteracts the force-storing spring. A second particularity of the drawer rail 5 is a height adjusting device 32 which is arranged in the front region and by way of which the front region of the drawer can be adjusted in height. The third particularity is an adjusting device 33 for adjusting the position of the drawer relative to the drawer rail 5, and the adjusting device 33 is disposed in the rear region of the drawer rail 5. It includes a holding projection 34 which projects into a corresponding opening in the drawer rear wall. That adjusting device 33 also serves at the same time as a push-in movement limiting means for the drawer.

Figures 2A, 2B:
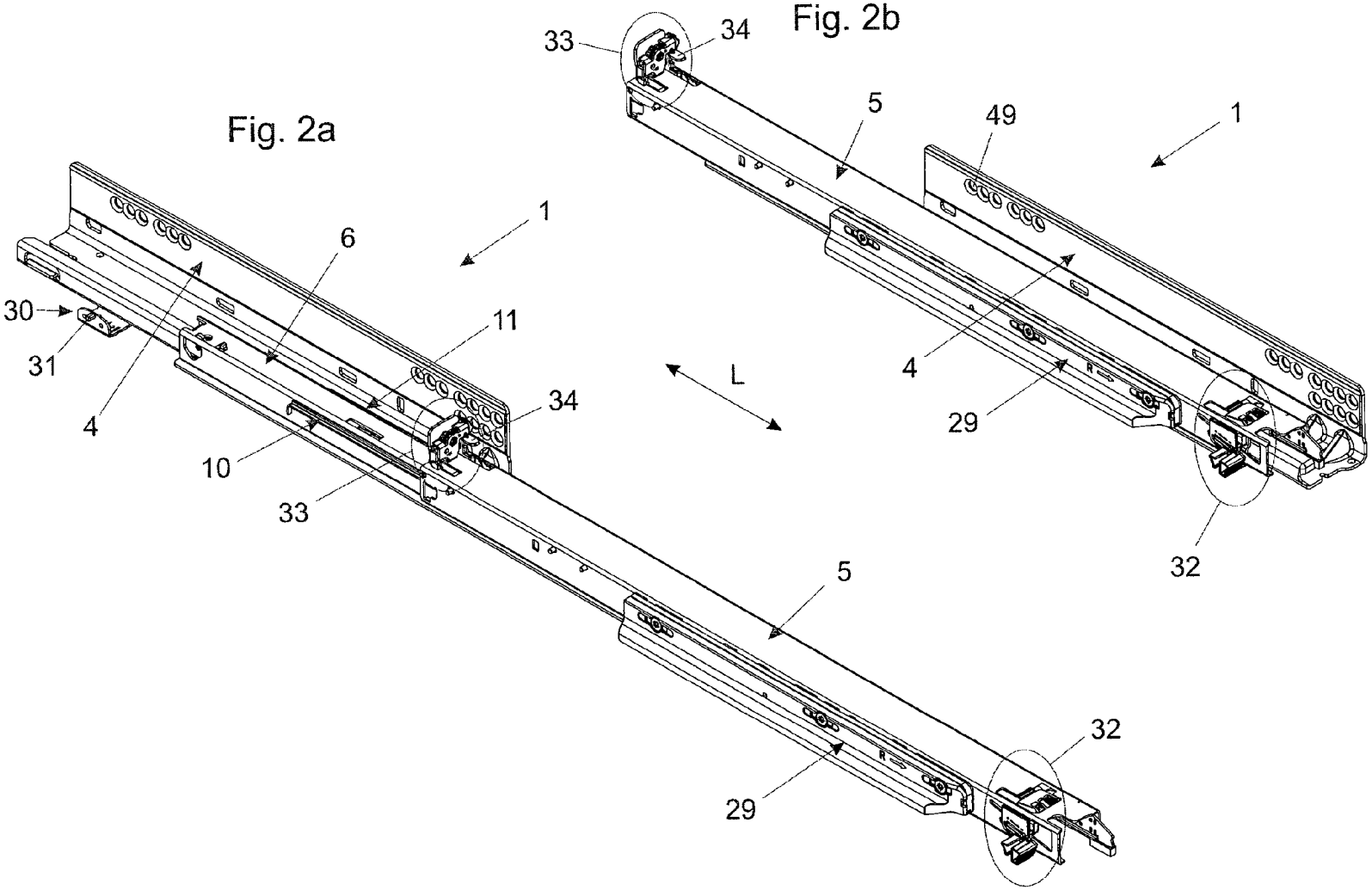
FIG. 2*a* is a diagrammatically illustrated perspective view of a preferred embodiment of the extension guide according to the invention in the pulled-out condition.
FIG. 2*b* is a diagrammatically illustrated perspective view of the preferred embodiment of the extension guide according to the invention in the pushed-together condition.
Figure 3:
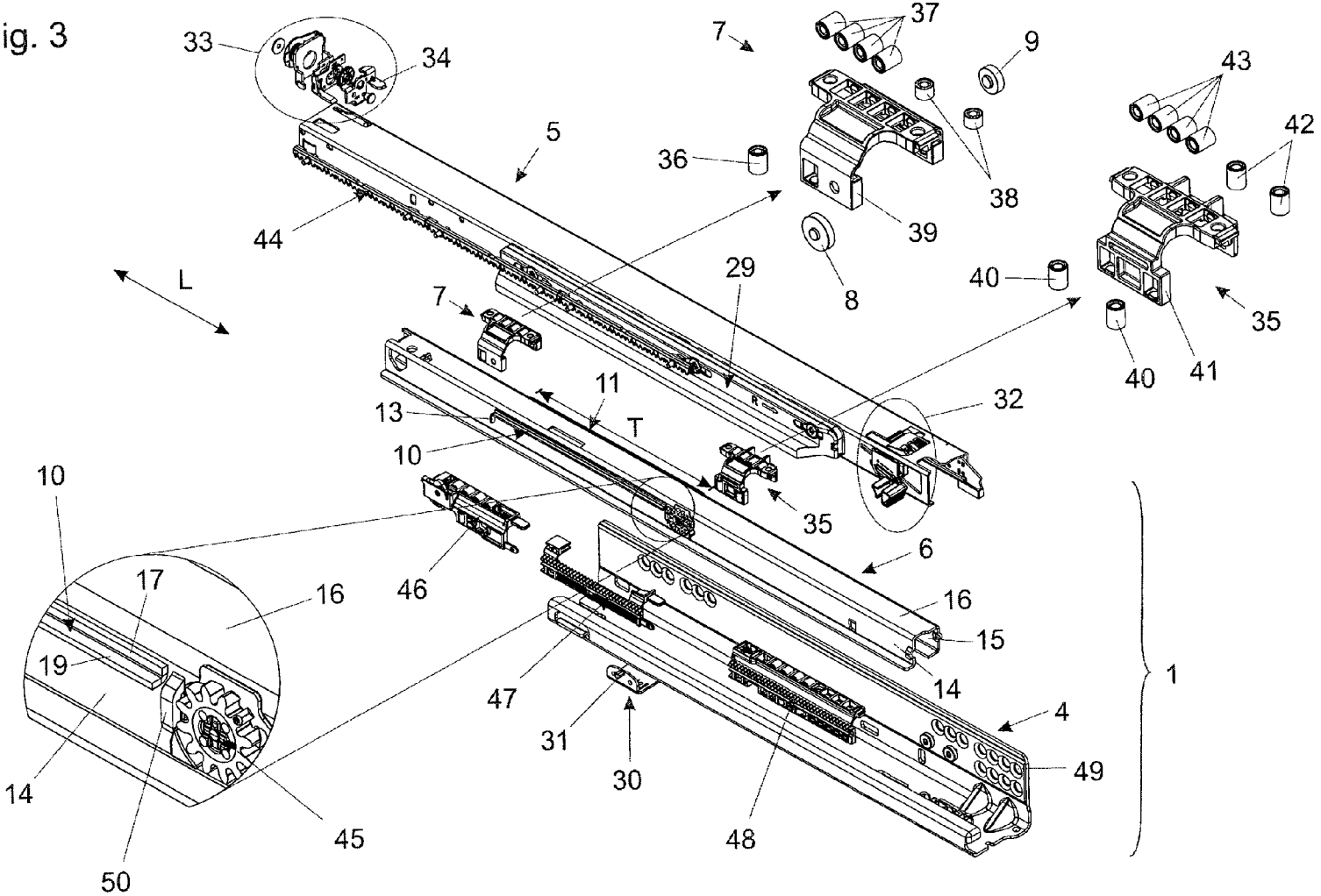
FIG. 3 is a diagrammatically illustrated exploded view of the preferred embodiment of the extension guide according to the invention.
Figure 4:
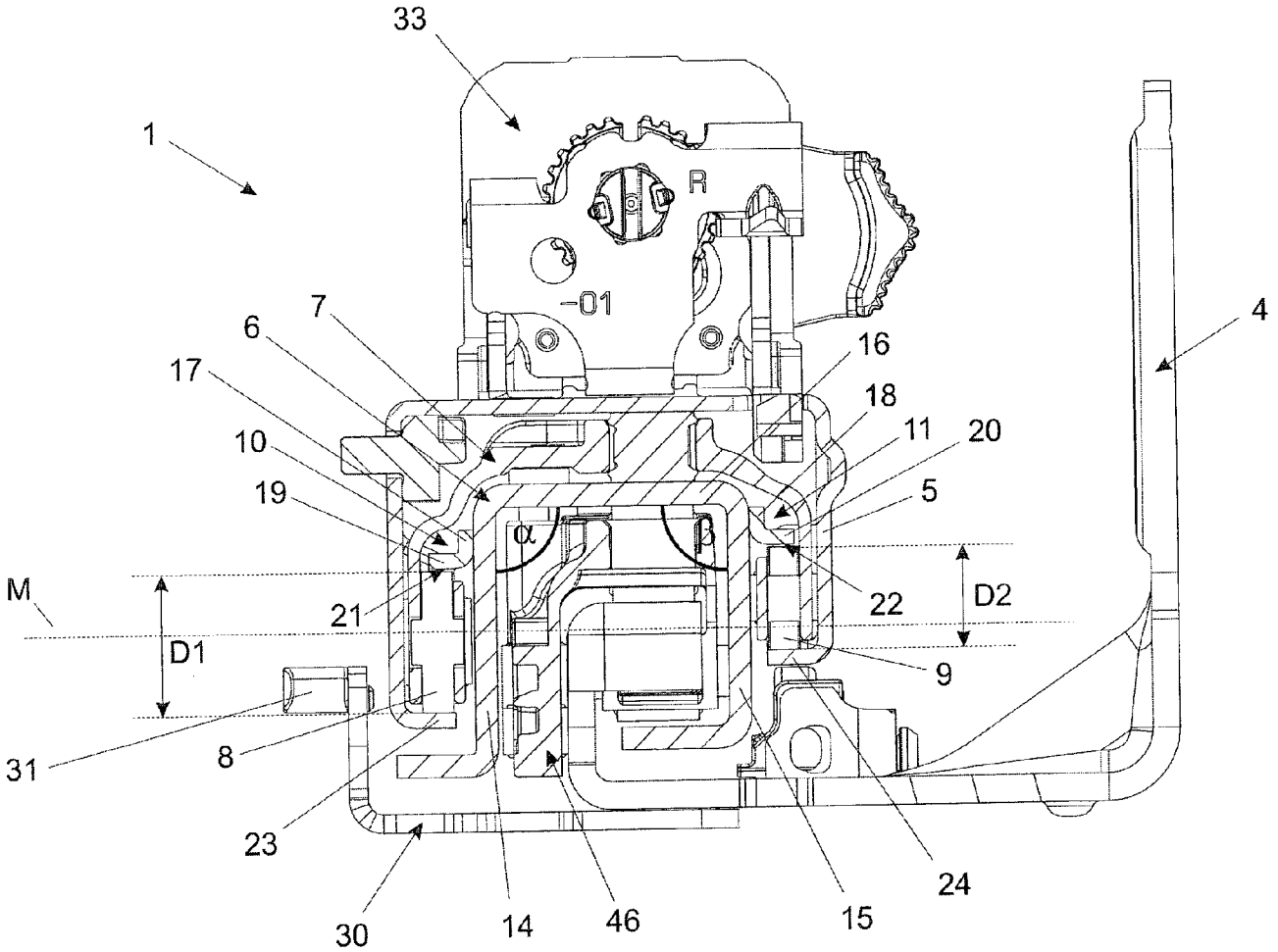
FIG. 4 is a diagrammatically illustrated cross-sectional view from the rear partial region of the preferred embodiment of the extension guide according to the invention.

It will be seen from FIG. 2*a* and from FIGS. 3 and 4 that the central rail 6 in cross-section is substantially in the form of a U-profile. In the position of use of the extension guide 1, the U-profile includes two vertical legs 14 and 15 and a horizontal bar 16 which connects the two vertical legs 14 and 15 together. Arranged on each of the two vertical legs 14 and 15 is a respective support profile 10 and 11 in the form of a separate structural unit. It should be pointed out that the angle bend edges between the two vertical legs 14 and 15 and the horizontal bar 16 include an angle $\alpha$ and $\beta$ respectively of 90°. In cross-section, the two support profiles 10 and 11 are substantially L-shaped, wherein a first limb 17 and 18 of that L-shape respectively bears against a respective one of the two vertical legs 14 and 15, and the second limb 19 and 20 of the L-shape is oriented perpendicularly to the vertical legs 14 and 15. Further features of the support profiles 10 and 11 are that:

- they are arranged above a horizontal central plane M of the central rail 6, which plane is notional in the position of use of the extension guide 1,
- they extend over a rear partial region T of about 35% in the longitudinal direction L of the central rail 6,
- they completely consist of metal,
- they are fixed (welded) to the central rail 6, and
- they are of an integral configuration.

Two running carriages 7 and 35 are supported displaceably between the central rail 6 and the drawer rail 5, and the support profiles 10 and 11 extend only over the partial region T of the central rail 6, in which the rear running carriage 7 is displaceably supported. That rear running carriage 7 has two support rollers 8 and 9 which are mounted rotatably laterally in the running carriage cage 39, and which each run on a respective one of the two support profiles 10 and 11 of the central rail 6. More precisely, in the position of use of the extension guide 1, they engage under the support profiles 10 and 11 to prevent lifting off of the central rail 6. In other words, they run at the downwardly directed side 21 and 22 of the two limbs 19 and 20 of the L-shape of the support profiles 10 and 11, respectively. It should also be pointed out that the movement of those two support rollers 8 and 9 in the longitudinal direction L of the central rail 6 is limited on the one hand by an abutment 13 arranged on the support profiles 10 and 11, and on the other hand by an abutment 50 arranged on the central rail 6. In addition to the two support rollers 8 and 9, further rolling bodies 36, 37 and 38 are mounted rotatably in the running carriage cage 39 of the running carriage 7, by way of which further rolling bodies the running carriage 7 runs on the two vertical legs 14 and 15 and the horizontal bar 16 of the central rail 6 and against the underside of the drawer rail 5. The front running carriage 35 is, in principle, of exactly the same structure as the rear running carriage 7, with the difference that it does not have any support rollers to safeguard against lifting off the central rail 6. Two running carriages 46 and 48 are also supported displaceably between the central rail 6 and the carcass rail 4, and those running carriages 46 and 48 are coupled together by way of a coupling device 47. For the sake of completeness, attention is also directed to a particularity shown in FIG. 3. The preferred embodiment of the extension guide 1 according to the invention includes a synchronization device which is known per se from the state of the art and which includes a rack 44 fixed to the drawer rail 5, a gear 45 fixed to the central rail 6, and a rack arranged on the running carriages 46 and 48 supported displaceably between the central rail 6 and the carcass rail 4. This synchronization device provides for synchronization of the movement of the drawer rail 5 relative to the central rail 6, and the movement of the central rail 6 relative to the running carriages 46 and 48 arranged between the central rail 6 and the carcass rail 4.

If the cross-sectional view shown in FIG. 4 of the preferred embodiment of the extension guide 1 according to the invention is considered more closely, it can be clearly seen that a shallow bent-over contact leg 23 and 24 is respectively arranged at right and left sides on the drawer rail 5, the two contact legs 23 and 24 being oriented parallel to the notional horizontal central plane M of the central rail 6. With those two contact legs 23 and 24, the drawer rail 5 engages under the support rollers 8 and 9, respectively, of the rear running carriage 7 and thus prevents the drawer rail 5 from lifting off the running carriage 7. The running carriage 7 is, in fact, in turn safeguarded against lifting off the central rail 6 by the two support rollers 8 and 9 by virtue of engaging under the support profiles 10 and 11. It will further be seen that the two lateral support rollers 8 and 9 of the rear running carriage 7 have different diameters D1 and D2, and they are arranged mounted rotatably on the running carriage 7 at different heights. In addition, the two support profiles 10 and 11 are arranged asymmetrically on the two vertical legs 14 and 15 of the central rail 6.

Even if the invention was described in specific terms by means of the illustrated embodiment, it will be appreciated that the subject-matter of the application is not limited to that embodiment. Rather, measures and modifications which serve to implement the concept of the invention are obviously conceivable and desired. Thus, for example, the support profiles in cross-section, instead of being of the L-shape, could be of a different shape, for example being at least region-wise of a circular and/or elliptical configuration, or as the outline of a right-angled triangle. It is also conceivable that the support profiles comprise not (just) metal, but instead (or also) they can comprise plastic or other materials. In addition—besides the above-mentioned possibility of attachment by welding—there are many other different possible ways of fixing the support profiles to the central rail, for example by riveting, screwing or soldering.

The invention claimed is:

1. An extension guide for a drawer, said extension guide comprising:

a carcass rail to be fixed to a furniture carcass; a drawer rail to be fixed to the drawer;

a central rail mounted movably between said carcass rail and said drawer rail; and a running carriage including a first rolling body and a second rolling body mounted displaceably between said central rail and said drawer rail such that said first rolling body and said second rolling body each run on a respective one of at least two support profiles of said central rail, each of said at least two support profiles having a substantially L-shaped cross section and being a separate structural unit fixed to said central rail;

wherein said central rail has a substantially U-shaped cross section with two vertical legs and a horizontal bar interconnecting said two vertical legs, a first one of said at least two support profiles being fixed to a first one of said two vertical legs, and a second one of said at least two support profiles being fixed to a second one of said two vertical legs; and wherein said central rail and said at least two support profiles are arranged such that each of said first rolling body and said second rolling body of said running carriage contacts and runs on a lower surface of said respective one of said at least two support profiles, said lower surface of each of said at least two support profiles being below a plane of a lower surface of said horizontal bar such that no part of said at least two support profiles contacts a top surface of said horizontal bar and such that each of said at least two support profiles is fixed solely to a respective one of said two vertical legs of said central rail.

2. The extension guide as set forth in claim 1, wherein said running carriage is configured to engage under said at least two support profiles during use of the extension guide so that said first rolling body and said second rolling body safeguard against lifting of said central rail.

3. The extension guide as set forth in claim 1, further comprising a contact leg arranged on said drawer rail, said drawer rail being configured to engage under said first rolling body and said second rolling body of said running carriage during use of the extension guide so that said contact leg safeguards against lifting of said running carriage.

4. The extension guide as set forth in claim 1, wherein each of said at least two support profiles extends in the longitudinal direction of said central rail along only between 20% and 60% of said length of said central rail.

5. The extension guide as set forth in claim 4, wherein each of said at least two support profiles extends in the longitudinal direction of said central rail along only between 30% and 40% of said length of said central rail.

6. The extension guide as set forth in claim 1, wherein at least one of said at least two support profiles includes an abutment configured to limit a movement of said rolling body in the longitudinal direction of said central rail.

7. The extension guide as set forth in claim 1, wherein said at least two support profiles are arranged above a horizontal central plane of said central rail, said horizontal central plane being notional during use of the extension guide.

8. The extension guide as set forth in claim 7, wherein said at least two support profiles are arranged completely above a horizontal central plane of said central rail.

9. The extension guide as set forth in claim 1, wherein each of said at least two support profiles is at least partially comprised of metal.

10. The extension guide as set forth in claim 9, wherein each of said at least two support profiles is entirely comprised of metal.

11. The extension guide as set forth in claim 1, wherein each of said at least two support profiles is welded to said central rail.

12. The extension guide as set forth in claim 1, wherein each of said at least two support profiles has a one-piece construction.

13. The extension guide as set forth in claim 1, wherein bends between each of said two vertical legs and said horizontal bar are formed at an angle of between 80° and 100°.

14. The extension guide as set forth in claim 13, wherein said bends between each of said two vertical legs and said horizontal bar are formed at an angle of 90°.

15. The extension guide as set forth in claim 1, wherein a first limb of each of said at least two L-shaped support profiles bears against a respective one of said two vertical legs, and a second limb of each of said at least two L-shaped support profiles is oriented substantially perpendicular to said respective one of said two vertical legs.

16. The extension guide as set forth in claim 15, wherein said first rolling body and said second rolling body are configured to run on a downwardly-facing side of said second limb of each of said at least two support profiles during use of the extension guide.

17. The extension guide as set forth in claim 1, wherein said first rolling body and said second rolling body have different diameters.

18. The extension guide as set forth in claim 1, wherein said first one of said at least two support profiles is fixed to a first lateral side of said central rail, and said second one of said at least two support profiles is fixed to a second lateral side of said central rail opposite said first lateral side.

19. The extension guide as set forth in claim 1, wherein each of said at least two support profiles extends in a longitudinal direction of said central rail along only a portion of a length of said central rail, said portion of said length of said central rail being located closer to a rear wall of the drawer than to a front wall of the drawer.

* * * * *